United States Patent [19]

Houle

[11] 4,137,079

[45] Jan. 30, 1979

[54] ANTIFOGGANTS IN HEAT DEVELOPABLE PHOTOGRAPHIC MATERIALS

[75] Inventor: Conrad G. Houle, Webster, N.Y.

[73] Assignee: Eastman Kodak Company, Rochester, N.Y.

[21] Appl. No.: 892,594

[22] Filed: Apr. 3, 1978

[51] Int. Cl.[2] ..... G03C 7/00; G03C 1/40; G03C 1/02; G03C 1/34

[52] U.S. Cl. ..... 96/55; 96/100 R; 96/109; 96/114.1

[58] Field of Search ..... 96/114.1, 109, 100, 96/77, 55

[56] References Cited

U.S. PATENT DOCUMENTS

| | | | |
|---|---|---|---|
| 2,403,927 | 7/1946 | Kendall et al. | 96/109 |
| 3,307,948 | 3/1967 | Thiers et al. | 96/66.3 |
| 3,457,075 | 7/1969 | Morgan et al. | 96/67 |
| 3,531,286 | 9/1970 | Renfrew | 96/67 |
| 3,637,393 | 1/1972 | Sakamoto et al. | 96/109 |
| 3,666,477 | 5/1972 | Goffe | 96/114.1 |
| 3,761,270 | 9/1973 | deMauriac et al. | 96/77 |
| 3,764,328 | 10/1973 | Birkeland | 96/67 |
| 3,832,186 | 8/1974 | Masuda et al. | 96/114.1 |
| 3,997,346 | 12/1976 | Masuda et al. | 96/50 PL |
| 4,002,479 | 1/1977 | Suzuki et al. | 96/114.1 |

FOREIGN PATENT DOCUMENTS

| | | | |
|---|---|---|---|
| 2558951 | 8/1976 | Fed. Rep. of Germany. | |
| 1466188 | 12/1966 | France | 96/61 R |
| 1049052 | 11/1966 | United Kingdom. | |

OTHER PUBLICATIONS

"Heat Developable...Process" Knight et al., Research Disclosure No. 15869, 6/1977, pp. 80 & 81.

"Heat Developable...Process" deMauriac, Research Disclosure No. 15026, 10/1976, pp. 18–21.

Derwent Abstract No. 72805x.

Product Licensing Index, No. 9232, 12/1971, pp. 107–110.

*Primary Examiner*—Richard L. Schilling

*Attorney, Agent, or Firm*—Rochard E. Knapp

[57] ABSTRACT

A heat developable photographic material for producing a dye enhanced silver image comprising, in binder, in reactive association, (a) photosensitive silver halide, (b) a dye-forming coupler, (c) an oxidation-reduction image-forming combination comprising (i) a 3-amino-1H-1,2,4-triazole silver salt oxidizing agent, with (ii) an organic reducing agent which in its oxidized form forms a dye with the dye-forming coupler, and (d) an antifoggant concentration of a 5-mercapto-1,2,4-triazole antifoggant, provides developed, dye enhanced silver images with reduced fog upon processing. An image can be developed in this photographic material by merely heating the material. Other addenda employed in heat developable photographic materials, such as sensitizing dyes, can be useful with the described photographic materials.

35 Claims, No Drawings

ANTIFOGGANTS IN HEAT DEVELOPABLE PHOTOGRAPHIC MATERIALS

BACKGROUND OF THE INVENTION

1. Field of the Invention

This invention relates to heat developable photographic materials and processes for developing a dye enhanced silver image employing, in binder, in reactive association, (a) photosensitive silver halide, (b) a dye-forming coupler, (c) an oxidation-reduction imge-forming combination comprising (i) a 3-amino-1H-1,2,4-triazole silver salt oxidizing agent, with (ii) an organic reducing gent which in its oxidized form forms a dye with the dye-forming coupler, and (d) an antifoggant concentration of a 5-mercapto-1,2,4-triazole antifoggant as described herein. In one of its aspects it relates to a photothermographic element comprising a support having thereon the described photosensitive silver halide and combination of imaging materials and an antifoggant concentration of the 5-mercapto-1,2,4-triazole antifoggant. In another of its aspects it relates to a photographic composition, especially a photothermographic composition, comprising the described photosensitive silver halide and imaging composition with the antifoggant concentration of the 5-mercapto-1,2,4-triazole antifoggant. A further aspect of the invention relates to a process of developing a dye enhanced silver image in a photographic material, especially a photothermographic material, containing the described imaging combination and the described antifoggant.

DESCRIPTION OF THE STATE OF THE ART

It is known to provide an image in an imaging material, especially a photographic imaging material, by what is known as dry processing with heat. Such an imaging material is often described as a heat developable photographic material or photothermographic material. Such heat developable photographic materials after imagewise exposure are heated to moderately elevated temperatures to provide a developed image in the absence of a processing solution or bath.

A photothermographic material is known comprising, in reactive association, (a) photosensitive silver halide, and combination comprising (b) an image-forming combination comprising (i) a silver salt of certain 1,2,4-mercaptotriazole derivatives with (ii) a silver halide developing agent. This photothermographic material is described in copending U.S. application Ser. No. 778,183 of Knight, deMauriac and Graham, filed March 16, 1977, commonly assigned with the present application to Eastman Kodak Company, Rochester, New York. It is also known to provide dye enhancement of the silver image in this photothermographic material. This is described in, for example, copending U.S. application Ser. No. 892,593, of Willis, Knight and Pupo, filed April 3, 1978, entitled "Photographic and Thermographic Material and Process," commonly assigned with the present application to Eastmen Kodak Company, Rochester, New York. The dye enhanced silver imaging material, however, can result in the problem of fog forming during development. No answer to this fog problem is evident from the art described.

It is also desired in many cases to spectrally sensitize heat developable photographic materials to enable exposure to other than the blue region of the visible spectrum. Difficulty is often encountered in spectrally sensitizing photosensitive silver halide to be used in heat developable materials. While in many cases some degree of spectral sensitization can be provided, it is often insufficient for many photographic purposes. It has been desirable to provide a heat developable silver halide photograhic material which (1) forms a dye enhanced silver image and (2) is based on photographic technology which permits use of a boarder range of spectral sensitizing dyes while providing reduced fog upon processing.

There has been a need for improved heat developable photographic materials for producing a dye enhanced silver image having reduced fog when using photosensitive silver halide with a dye-forming coupler, especially a resorcinol dye-forming coupler, and with an image-forming combination comprising a silver salt of certain 1,2,4-mercaptotriazole derivatives with an organic reducing agent. A need has also existed for antifoggants that produce reduced fog upon development of an image in such photographic materials while enabling improved development acceleration.

SUMMARY OF THE INVENTION

It has been found according to the invention that the described advantages are provided in a heat developable photograhic material for producing a dye enhanced silver image comprising, in binder, in reactive association, (a) photosensitive silver halide, (b) a dye-forming coupler, especially a resorcinol, dye-forming coupler, (c) an oxidation-reduction image-forming combination comprising (i) a 3-amino-1H-1,2,4-triazole silver salt oxidizing agent, with (ii) an organic reducing agent which in its oxidized form forms a dye with the dye-forming coupler, and (d) an antifoggant concentration of a 5-mercapto-1,2,4-triazole represented by the formula:

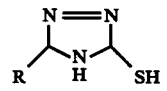

wherein R is H or alkyl containing 1 to 3 carbon atoms, such as methyl, ethyl, and propyl. Especially useful photographic materials as described are those wherein the 3-amino-1H-1,2,4-triazole silver salt is a silver salt of a compound represented by the formula:

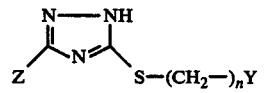

wherein Y is aryl containing 6 to 12 carbon atoms, such as phenyl, naphthyl, para-chlorophenyl, and para-methoxyphenyl; $n$ is 0 to 2; and Z is hydrogen, hydroxyl or amine ($—NH_2$). Especially useful organic reducing agents in the described heat developable photographic material are phenylenediamine and aminophenol silver halide developing agents as described herein. Preferably, for many uses, the developed, dye enhanced silver image is neutral (black) or nearly neutral appearing. It has been surprisingly found that the antifoggant concentration of the 5-mercapto-1,2,4-triazole antifoggant not only provides desired reduction of fog in the photographic material, but also provides unexpectedly improved development acceleration at lower processing time and temperature ranges.

It has also been found according to the invention that in the described heat developable photographic materials containing the antifoggant concentration of a 5-mercapto-1,2,4-triazole, as described, that certain development accelerators such as a 5-thiourazole development accelerator, a 2-tetrazoline-5-thione development accelerator, or a development accelerating concentration of certain 5-mercapto-1,2,4-triazole compounds can provide desired increase in development without adversely affecting the desired antifoggant properties and other sensitometric properties of the heat developable material. The surprising development acceleration is illustrated in, for instance, following Examples 5, 6, 7, 10 and 12.

A developed image having reduced fog and other of the described properties in a heat developable photographic material, also as described, can be produced after imagewise exposure of the material by merely heating the exposed material at moderately elevated temperatures, such as a temperature within the range of about 120° C to about 185° C, especially a temperature within the range of about 150° C to about 170° C until the desired dye and silver image is developed. Certain of the described heat developable photographic materials can provide not only a developed image having reduced fog, but also a developed iage that is stable after processing. Especially useful heat developable photograhic materials according to the invention are those that provide a developed and stabilized image having reduced fog with the described development acceleration. These especially useful materials include, for example, those described wherein Z is amine ($—NH_2$), *n* is 1 and Y is phenyl, para-methoxyphenyl or para-chlorophenyl. An especially useful antifoggant in such a material consists essentially of 3-methyl-5-mercapto-1,2,4-triazole.

Preferred dye-forming couplers are compounds that form a neutral (black) or nearly neutral appearing dye in the photographic material in the image areas upon processing. Especially useful compounds are resorcinol dye-forming couplers that form a dye with the oxidized form of the described reducing agent.

The photographic materials according to the invention can provide a dye enhanced silver image that is typically a neutral or nearly neutral appearing image having increased maximum density, image formation with development acceleration, and desired reduced fog.

DETAILED DESCRIPTION OF THE INVENTION

The term "material", such as in photographic material, as used herein, is intended to include a photographic element and a photographic composition.

The term "neutral", such as in neutral image, as used herein, is intended to include hues which occasionally are referred to in the photographic art as blue-black, gray, purple-black, black and the like. Whether or not a given developed image is "neutral" can be readily determined by visual inspection.

One embodiment of the invention is a heat developable photographic element for providing a dye enhanced silver image comprising a support having thereon, in reactive association, described components (a), (b), (c) and (d).

An especially useful silver salt in the described heat developable photographic material is the silver salt of 3-amino-5-benzylthio-1,2,4-triazole.

Combinations of the described silver salts are also useful. The optimum combination of silver salts can according determined based on such factors as the desired image, other components in the photograhic material, processing conditions, the particular antifoggant and the like.

It has been found that those compounds in which Y is alkyl rather than aryl accoridng to the described formula, provide less than desirable results in certain heat developable photographic materials. Specifically, the developed image has the disadvantages that a less than a desired image and possibly undesirably high fog may be obtained.

A variety of 5-mercapto-1,2,4-triazole antifoggants is useful in the described heat developable photographic material. An especially useful 5-mercapto-1,2,4-triazole is represented by the formula:

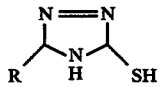

wherein R is H or alkyl containing 1 to 3 carbon atoms, such as methyl, ethyl, and propyl. Examples of useful 5-mercapto-1,2,4-triazoles include 3-methyl-5-mercapto-1,2,4-triazole, and 3-ethyl-5-mercapto-1,2,4-triazole. Combinations of the described 5-mercapto-1,2,4-triazole antifoggants can also be useful in the described materials according to the invention.

Selection of an optimum antifoggant concentration for a described photographic material according to the invention will depend upon such factors as the particular photographic materal, the particular photosensitive silver halide, the image-forming combination, the desired image, processing conditions, the particular antifoggant and the like. In a heat developable, photographic element according to the invention an antifoggant concentration is typically within the range of about 5.5 to about 110 milligrams per square meter of support of the heat developable photographic element (equivalent to about 0.5 to about 10 milligrams per square foot). An especially useful concentration of antifoggant is in a heat developable photographic element, as described, is typically about 32–33 milligrams per square meter of support of the heat developable photographic element (equivalent to about 3 milligrams per squre foot). In a heat developable photographic composition according to the invention an antifoggant concentration is typically equivalent to that concentration described for a photographic element. This antifoggant concentration in a heat developable composition is typically within the range of about 0.45 g to about 9.0 g of the 5-mercapto-1,2,4-triazole per mole of silver in the heat developable photographic composition.

The described 5-mercapto-1,2,4-triazole compounds can be prepared by procedures known in the chemical art. The described 1,2,4-mercaptotriazole derivatives from which the 3-amino-1H-1,2,4-triazole silver salt oxidizing agent is prepared can be prepared with procedures known in the chemical art. For example, the preparation of 3-amino-5-benzylthio-1,2,4-triazole can be carried out with the procedure described in the *Journal of the Chemical Society,* 3437 (1960) by L. Godfrey and F. Kurzer. In this preparation, for example, benzochloride (135 grams, 1.1 mole) is added dropwise to a mixture of 5-mercapto-3-amino-1,2,4-triazole (116 grams, 1 mole) with 1600 milliliters of ethanol, sodium hydroxide (44 grams, 1.1 mole) and 900 milliliters of water. The reaction mixture is heated at reflux for 6 hours. At the end of this time the ethanol is removed by distillation under reduced pressure; 1,000 milliliters of water is added, and the solution is cooled to 5° C. The resulting product can be separated and purified using methods known in the art such as recrystallization from a suitable solvent.

The 3-amino-1H-1,2,4-triazole silver salt, described, can be prepared by mixing a source of silver ions, such as silver trifluoroacetate or silver nitrate, with the described 1,2,4-mercaptotriazole derivative until reaction completion. Some heat may be required to solubilize the ligand unless the solutions are used in the preparation. The desired silver salt can be separated by filtration or washing or other known separation techniques. Preparation of a silver salt of the described 1,2,4-mercaptotriazole derivative is described in, for example, copending U.S. application Ser. No. 778,183 of Knight, deMauriac and Graham, filed March 16, 1977. The preparation of the 3-amino-5-benzylthio-1,2,4-triazole silver salt is illustrative of the preparation of the silver salts useful in the described materials of the inventiion. In this preparation the silver salt is prepared in the form of a dispersion. 6.18 grams (0.03 mole) of 3-amino-5-benzylthio-1,2,4-triazole and 4.0 grams of deionized photographic gelatin are dissolved with heat at 50° C into 30 milliliters of a mixture of ethanol and methanol (95:5 parts by volume ethanol:methanol) and 140 milliliters of distilled water. The resulting solution was placed in a suitable reaction vessel equipped with a rapid mixing means and then a solution of 3.4 grams (0.02 mole) of silver nitrate in 30 milliliters of distilled water was added rapidly at 50° C while the solution was rapidly mixed. The reactants were mixed rapidly for 40 minutes followed by cooling to about 19° C. The resulting desired dispersion was diluted to 200 grams (10 kilograms per silver mole) with distilled water. The end dispersion had a pH of 2.8 and a pAg of 4.6.

It is also useful to prepare the described 3-amino-1H-1,2,4-triazole silver salt oxidizing agent in other compositions than in gelatin as described, such as, for example, in poly(vinyl alcohol). Other compositions can be in the form of organic solvent or aqueous solutions or the like in the absence of a polymeric vehicle. The 3-amino-1H-1,2,4-triazole silver salt oxidizing agent can be separated in pure form and stored prior to use. However, for photographic purposes it is often useful to prepare the silver salt oxidizing agent in the form of a dispersion. The reactants in the described preparation of the silver salt oxidizing agent can be mixed in stoichiometric concentrations. However, it is often desirable to mix one of the components in excess of these concentrations to insure the desired degree of reaction. The reaction can be carried out at a temperature within the range of about 40° C to about 80° C, typically a temperature within the range of about 50° C to about 60° C.

Preparation of the described 3-amino-1H-1,2,4-triazole silver salt oxidizing agent is usually not carried out in situ. That is, the preparation is not usually carried out in the presence of other components of the heat developable photographic material as described, but rather is carried out ex situ. That is, the preparation is carried out separate from other components of the heat developable photographic material.

The term "salt" as used herein is intended to include salts and complexes which enable the resulting material to provide imaging properties in the described heat developable photographic materials and processes according to the invention. The exact bonding in these salts and complexes is not fully understood. For instance, the exact bonding of the described 3-amino-1H-1,2,4-triazole silver salt is not fully understood. Accordingly, the bonding in a "salt", as described, is intended to include salt forms of bonding, complex bonding and other forms of bonding which enable the desired image-forming combination to provide the desired image. The term "salt" is intended to include neutral complexes and non-neutral complexes.

The heat developable photographic materials according to the invention comprise a photosensitive component which is photosensitive silver halide. The photosensitive silver halide is especially useful because it has higher photosensitivity compared to other photosensitive components. A typical concentration of photosensitive silver halide in a photographic material according to the invention is within the range of about 0.5 to about 1.0 mole of photosensitive silver halide per mole of the described silver salt oxidizing agent in the photographic material. For example, a typical concentration of photosensitive silver halide is within the range of about 0.1 to about 0.5 mole of the photosensitive silver halide per mole of silver salt oxidizing agent, as described, in the photographic material. Other photosensitive materials can be useful in combination with the described photosensitive silver halide if desired. Preferred photosensitive silver halides are silver chloride, silver bromide, silver bromoiodide, silver chlorobromoiodide or mixtures thereof. For purposes of the invention, silver iodide is also considered to be useful as a photosensitive silver halide; however, silver iodide is typically more difficult to stabilize after processing than silver bromide in a photographic material according to the invention. Various grain sizes of photosensitive silver halide can be useful in the described heat developable photographic materials ranging from very fine-grain silver halide to coarse-grain silver halide. The photosensitive silver halide can be prepared by any of the procedures known in the photographic art, especially those procedures which involve the preparation of photographic silver halide gelatino emulsions. Useful procedures and forms of photosensitive silver halide for purposes of the invention are described, for example, in the *Product Licensing Index,* Volume 92, December 1971, Publication No. 9232 on page 107, published by Industrial Opportunities Ltd., Homewell, Havant Hampshire, P09 1EF, UK. Cubic grain silver bromoiodide, such as silver bromoiodide containing about 2.5 mole percent iodide can be particularly useful. The photosensitive silver halide, as described, can be washed or unwashed, can be chemically sensitized using chemical sensitization procedures and materials known in the art, and can be mixed with the described photographic materials using procedures known in the photographic art.

The photographic materials according to the invention can cntain a variety of organic reducing agents. It is necessary that the organic reducing agent be one which can in its oxidized form form a dye with the described dye-forming coupler. For this purpose, the most useful organic reducing agents are primary aromatic amines, especially phenylenediamine reducing agents or reducing agent combinations. The optimum organic reducing agent or reducing agent combination, especially the optimum phenylenediamine developing agent or developing agent combination, will depend upon such factors as the particular components of the photographic material, the particular photosensitive silver halide, the desired image, the particular coupler, processing conditions, and the like. The optimum developing agent, coupler, silver salt oxidizing agent combination can be determined by a simple test as described in following Examples 1 and 2 wherein the antifoggant of Example 2 is employed. In this example the reducing agent, coupler and silver salt oxidizing agent can be included in place of the coupler, reducing agent and silver salt oxidizing agent of Example 1 and tested as described in Example 1 including the antifoggant of Example 2. If the maximum and minimum densities, contrast, and fog level are at least as satisfactory as those of Example 1 using the antifoggant of Example 2, the compounds are considered to be useful.

Examples of useful phenylenediamine reducing agents include, for example, 4-amino-2-carboxy-N,N-dimethylaniline sulfate; 4-amino-3,5-dichloro-N,N-dimethylaniline; 4-amino-N,N-diethyl-3-methyl-5-sulfoniline, potassium salt; 4-amino-3-methyl-N-ethyl-N-[β-(trimethylammonium)ethyl]aniline chloride, di-para-toluenesulfonate; 4-benzenesulfonamido-N,N-dimethylaniline and combinations thereof. Salt forms of the described reducing agents, as described, can be useful; however, in many cases the haloacid salts are preferably avoided to reduce undesired formation of silver halide. An especially useful phenylenediamine silver halide developing agent in the photographic materials of the invention consists essentially of 4-amino-2-methoxy-N,N,5-trimethylaniline sulfate.

The terms "organic reducing agent" and "silver halide developing agent" as employed herein are intended to include compounds which are reducing agent precursors and silver halide developing agent precursors in the described photographic materials of the invention. That is, those compounds are included which are not reducing agents or developing agents in the photographic material until a condition occurs, such as heating of the photographic material.

A useful concentration of the described organic reducing agent, especially the phenylenediamine and aminophenol developing agents, according to the invention is typically within the range of about 0.5 mole to about 5 moles of the reducing agent per mole of the silver salt oxidizing agent as described. An especially useful concentration of phenylenediamine or aminophenol developing agent is within the range of about 0.5 to about 2.0 moles of developing agent per mole of silver salt oxidizing agent. When a combination of reducing agents is used, the total concentration of the combination is within the described ranges. The concentration of reducing agent or reducing agent combination must be sufficient to provide development of the silver image desired and sufficient to provide adequate oxidized developing agent to react with the described dye-forming coupler to provide the desired dye image. The optimum concentration of reducing agent or reducing agent combination will depend upon such factors as the desired image, other components of the photographic material, processing conditions, parricular dye-forming coupler, and the like.

A variety of compounds is useful for the dye-forming coupler as described. The dye-forming coupler must be one which forms a dye with the oxidized form of the described reducing agent, especially the oxidized form of the phenylenediamine or aminophenol silver halide developing agent upon processing. That is, in a heat developable photographic material according to the invention the dye-forming coupler must form a dye with the oxidized form of the reducing agent upon heating the element after exposure to processing temperature. The dye-forming coupler is typically colorless in the heat developable photographic material according to the invention. The dye-forming coupler and other components in the materials of the invention should be stable to a sufficient degree that avoids any significant, adverse interaction in the photographic material prior to producing a desired image at processing temperatures. A simple test can be useful for selecting an optimum dye-forming coupler in a heat developable photographic material according to the invention. An example of such a test is described in following Example 1. In this example the dye-forming coupler to be tested is included in the heat developable photographic material described in place of the dye-forming coupler of Example 1. If the dye image produced in the resulting composition using the procedure of Example 1 is at least as satisfactory as that of Example 1, then the compound containing the coupling moiety is considered to be useful. A compound that is a dye-forming coupler which provides a netural (black) or nearly neutral appearing dye is preferred. The terms "dye-forming coupler" and "coupling moiety" as used herein, are intended to mean a compound or portion of a compound which in the photographic material of the invention and under the processing conditions reacts with the oxidized form of the reducing agent, especially the oxidized form of the phenylenediamine or aminophenol developing agent, to form a desired dye image. The dye-forming coupler is designated as such because it is believed that the compound containing a coupling moiety couples with the oxidized developing agent to provide the desired dye. The compound that contains the coupling moiety includes compounds that are known as photographic dye-forming couplers. Suitable compounds that contain coupling moieties that form a dye with the oxidized form of the described reducing agent include those that can withstand the processing temperatures according to the invention without adversely affecting the sensitometric properties of the photographic material. Useful compounds that are dye-forming couplers include those described within the scope of U.S. Pat. No. 3,761,270 of deMauriac and Lanholm, issued Sept. 25, 1973, the description of which is incorporated herein by reference. While a compound containing a coupling moiety that forms a neutral or nearly neutral dye is preferred, other dye-forming couplers or combinations of such couplers can be useful. A magenta dye-forming coupler which is useful according to the invention is 1-(2,4,6-trichlorophenyl)-3-[3-{α-(3-pentadecylphenoxy)-butyramido}benzamido]-5-pyrazolone. A useful cyan dye-forming coupler is 2,4-dichloro-1-naphthol. And, a useful yellow dye-forming coupler is α-[3-{α-(2,4-ditertiaryamylphenoxy)acetamido}benzoyl]-2-fluoroacetanilide. An especially useful dye-forming coupler in a photographic material according to the invention is a resorcinol dye-forming coupler. Useful resorcinol dye-forming couplers are described in, for example, copending U.S. Pat. Application Ser. No. 892,593 of Willis, Knight and Pupo, filed April 3, 1978, entitled "Photographic and Thermographic Material and Process," which is incorporated herein by reference and is commonly assigned with the present application to Eastman Kodak Company, Rochester, New York.

An especially useful dye-forming coupler is a resorcinol dye-forming coupler represented by the formula:

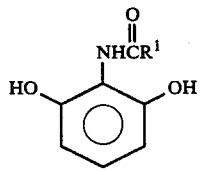

wherein $R^1$ is haloalkyl containing 1 to 3 carbon atoms, such as $CCl_3$, $CF_3$ and $C_3H_4Br_3$, $CH_2OCH_3$, $CH_2SR^2$, $NHR^3$, $C_2H_4COOH$, $CH{=}CH_2$, $NHC_2H_4Cl$, alkyl containing 1 to 20 carbon atoms, such as 1 to 10 carbon atoms, including methyl, ethyl, propyl, butyl, and decy, or phenyl; $R^2$ is alkyl containing 1 to 5 carbon atoms, such as methyl, ethyl, propyl or pentyl, or phenyl; and, $R^3$ is hydrogen, haloalkyl containing 1 to 3 carbon atoms, such as $CCl_3$, $CF_3$, and $C_3H_4Br$, $CH_2OCH_3$, or $C_2H_4COOH$. Alkyl and phenyl, as used herein, are intended to include unsubstituted alkyl and phenyl as well as alkyl and phenyl containing substituents that do not adversely affect the desired sensitometric or other properties of the described heat developable photographic material. Examples of useful substituents are methyl and chlorine. Preferred resorcinol dye-forming couplers are, for example, 2,6-dihydroxyacetanilide; 2',6'-dihydroxytrifluoroacetanilide; and an acetanilide represented by the formula:

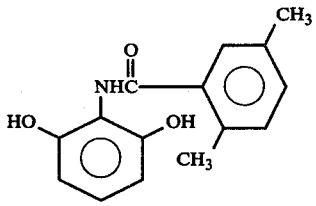

Due to differencs in solubility and other properties, it can be useful, in some cases, to coat a coupler, as described, in the form of a latex dispersion or other suitable form than a solution in a suitable solvent. Those couplers that are soluble in water can be usefully coated from an aqueous formulation.

Resorcinol dye-forming couplers, as described, can be prepared from aminoresorcinols or dihydroxybenzoic acids with procedures known in the chemical art.

Combinations of dye-forming couplers can be useful. The combination of such dye-forming couplers can be useful together to provide a neutral (black) or nearly neutral appearing dye that enhances the silver image as described.

A range of concentration of dye-forming coupler is useful in the described photographic material according to the invention. Typically, the concentration of dye-forming coupler is within the range of about 0.1 to about 1.5 moles, such as about 0.25 to about 0.75 mole, of the dye-forming coupler per mole of total silver in the photographic material. When a combination of dye-forming couplers is used, the total concentration of the combination is within the described range. The optimum concentration of the dye-forming coupler or dye-forming coupler combination will depend upon such factors as the particular reducing agent, the desired image, other components of the photographic material, processing conditions, and the like.

The photographic material according to the invention can contain a variety of colloids and binders alone or in combination as vehicles, binding agents and in various layers. Useful binders typically are polymeric binders. Useful colloids and binders, as described, are preferably hydrophilic materials although some hydrophobic materials can be useful. The colloids and binders are transparent or translucent and include both naturally-occurring substances such as proteins, for example, gelatin, gelatin cellulose derivatives, polysaccharides such as dextran and the like; and synthetic polymeric materials such as hydrophilic polyvinyl compounds like poly(vinyl pyrrolidone), acrylamide polymers and the like. Other synthetic polymeric materials that can be useful include dispersed vinyl compounds such as in latex form and particularly those that increase dimensional stability of the photographic materials. Effective polymers include high molecular weight materials, polymers and resins which are compatible with the described imaging components of the photographic materials according to the invention. In a photographic material according to the invention the binder or combination of binders selected must be able to withstand the processing temperatures employed without adversely affecting the desired properties of the photographic material. Especially useful materials include gelatin, poly(vinyl pyrrolidone), and poly(vinyl alcohol). Other useful materials include copolymers of acrylamide with 1-vinylimidazole or 2-acetoacetoxyethylmethacrylate. Combinations of the described colloids and binders can also be useful.

In many cases it is useful to have one or more of the described polymers or colloids as an overcoat layer or layers on the described material to increase resistance to abrasion marks and to provide other advantages.

It is often advantageous to include a base-release agent or base precursor in the heat developable photographic materials according to the invention to provide improved image development. A base-release agent or base precursor, as employed herein, is intended to include a compound or combination of compounds which upon heating in the photographic material according to the invention provide a more effective reaction between the described photosensitive silver halide, and the image-forming combination and provide a more useful dye enhanced silver image. Examples of useful base-release agents or base precursors are aminimide base-release agents as described in *Research Disclosure,* Vol, 157, May 1977, Items 15733, 15732, 15776 and 15734, guanidinium compounds, such as guanidinium trichloroacetate and other compounds which are known to release a base moiety but do not adversely affect photographic silver haide materials.

A range of concentration of the base-release agent or base precursor is useful in the described photographic materials of the invention. The optimum concentration of base-release agent or base precursor will depend upon such factors as the desired image, particular components in the photographic material, processing conditions, particular dye-forming coupler, and the like. A useful concentration of base-release agent or base precursor is typically within the range of about 0.25 to about 2.5 moles of base-release agent or base precursor per mole of silver in the photographic material. When a combination of base-release agents or base precursors is used, the total concentration of the combination is within the described range.

The photographic materials according to the invention can obtain an image toner to provide a neutral (black) or more neutral appearing image upon processing. The optimum toning agent will depend upon such factors as the particular photographic material, the desired image tone, particular processing conditions, particular components of the material and the like. In some cases certain image toning agents can provide better results with certain silver salt oxidizing agents than with other oxidizing agents. A simple test can be useful, for example, to select an optimum image toning agent or combination of image toning agents. One such test comprises that described in following Example 1 in which 0.1 mole of the toning agent per mole of silver to be tested is included in the described photographic material. If the tone of the resulting developed image is more neutral (black) than that of the example, the toning agent is considered to be useful. The most useful toning agent in the described test is typically that toning agent that provides the highest ratio of (a) visible maximum density to (b) blue light maximum density. When this ratio exceeds a value of about 0.9, the developed image appears neutral (black).

Useful toning agents include, for example, 6-methyl-2-thiouracil and 1-phenyl-2-tetrazoline-5-thione.

A range of concentration of toning agent or toning agent combination is useful in a photographic material according to the invention. A typically useful concentration of toning agent or toning agent combination is within the range of about 0.005 to about 0.05 mole of toning agent per mole of silver in the described photographic material. The optimum concentration of toning agent or toning agent combination will depend upon such factors as the particular photographic material, desired image, the nature of the toning agent, the particular dye-forming coupler, processing conditions and the like.

Certain development accelerators are useful in the photographic materials according to the invention to provide more rapid development during processing. The term "development accelerator" is intended herein to mean a compound that provides an overall increase in development rate, especially in the midscale. Useful development accelerators according to the invention include 5-thiourazole development accelerators such as 3-imino-4-phenyl-5-thiourazole; 2-tetrazoline-5-thione development accelerators; and such 5-mercapto-1,2,4-triazole development accelerators as 4-methyl-5-mercapto-1,2,4-triazole. An optimum development accelerator or combination of development accelerators will depend upon such factors as the particular photographic silver halide, other imaging components in the photographic material, desired image, processing conditions, and the like.

A range of concentration of development accelerator can be useful in the photographic material of the invention. Selection of an optimum concentration of development accelerator or development accelerator combination will depend upon the above described factors. Typically, the development accelerating concentration of the development accelerator is within the range of about 5.0 milligrams to about 220 milligrams of the development accelerator per square meter of the support of the photographic element.

An especially useful embodiment of the invention is a heat developable photographic element for providing a dye enhanced silver image comprising a support having thereon, in a gelatino binder, in reactive association, (a) photosensitive silver halide gelatino emulsion, (b) an oxidation-reduction image-forming combination comprising (i) a 3-amino-5-benzylthio-1,2,4-triazole silver salt, with (ii) a phenylenediamine reducing agent consisting essentially of 4-amino-2-methoxy-N,N,5-trimethylaniline sulfate, (c) a resorcinol dye-forming coupler consisting essentially of 2',6'-dihydroxytrifluoroacetanilide, and (d) an antifoggant concentration of 3-methyl-5-mercapto-1,2,4-triazole. The silver halide is preferably a gelatino silver bromoiodide photographic emulsion.

In this embodiment it is especially useful to include a development accelerating concentration of a development accelerator such as 1-phenyl-2-tetrazoline-5-thione, 3-imino-4-phenyl-5-thiourazole or 4-methyl-5-mercapto-1,2,4-triazole.

Spectral sensitizing dyes can be useful in the described photographic materials of the invention to confer additional sensitivity to those described materials. Useful sensitizing dyes are described, for example, in the *Product Licensing Index,* Volume 92, December 1971, Publication No. 9232, pages 107–110, paragraph XV, published by Industrial Opportunities Ltd., Homewell, Havant Hampsire, P09 1EF, UK. A range of spectral sensitizing dyes can be useful in the described materials. Selection of an optimum spectral sensitizing dye or dye combination will depend upon such factors as the particular photosensitive silver halide, the desired spectral sensitivity, other components of the photographic material, and the like. A preferred photographic material according to the invention contains a spectral sensitizing dye selected from the group consisting of cyanine and merocyanine spectral sensitizing dyes and combinations of these dyes. Especially useful spectral sensitizing dyes include thiocarbocyanine dyes, merocyanine dyes containing a rhodanine moiety, solubilized oxacarbocyanine dyes, oxacarbocyanine dyes and merocyanine dyes containing a 2-thio-2,4-oxazolidinedione moiety.

A range of concentration of spectral sensitizing dye or dye combination is useful in the described photographic materials. Typically, the spectral sensitizing dye or dye combination concentration is within the range of about 0.5 to about 2.0 grams of spectral sensitizing dye or dye combination per mole of photosensitive silver halide.

The optimum concentration of the various components of the photographic material according to the invention will depend upon a variety of factors as described. An especially useful photograhic material according to the invention comprises for each mole of photosensitive silver halide, about 2.0 to about 20.0 moles of the described silver salt oxidizing agent and about 1.0 to about 5.0 moles of the described reducing agent with 1.0 to 5.0 moles of dye-forming coupler.

The 3-amino-1H-1,2,4-triazole silver salt can contain a range of ratio of the 3-amino-1H-1,2,4-triazole moiety to the silver ion. The optimum ratio of the triazole moiety to silver ion will depend upon such factors as the particular triazole derivative, the particular photographic material in which it is to be used, processing conditions and the like. However, the molar ratio of the described triazole moiety to silver as silver ion in the silver salt oxidizing agent is typically within the range of about 0.5 to about 3.0. An especially useful ratio of the described 3-amino-1H-1,2,4-triazole moiety to silver as silver ion is about 1.5.

The heat developable photographic material of the invention can also contain a range of pAg. The pAg can be measured using conventional calomel and silver-silver chloride electrodes, connected to a commercial digital pH meter. The typical pAg in a dispersion containing the described components according to the invention is within the range of about 2.5 to about 7.5, with a preferred range of pAg within the range of about 3.5 to about 6.5. The optimum pAg will depend upon the described factors, such as the particular photographic material, desired image, processing conditions and the like.

A dispersion containing the described components according to the invention typically has a pH within the range of about 1.5 to about 7.0. An especially useful pH is within the range of about 2.0 to about 6.0, preferably within the range of about 2.5 to about 5.0.

The photographic materials according to the invention can contain other addenda, such as development modifiers that function as speed-increasing compounds, hardeners, plasticizers and lubricants, matting agents, coating aids, brighteners, absorbing and filter dyes, antistatic materials or layers and the like. These are described, for example, in the *Product Licensing Index,* Volume 92, December 1971, Publication No. 9232, pages 107-110, published by Industrial Opportunities Ltd., Homewell, Havant Hampshire, PO9 1EF, UK.

The described components of the photographic materials can be in any suitable location in the photographic materials which provide the desired image. For example, if desired, one or more of the components of the photographic element can be in one or more layers of the element. In some cases it can be desirable to include certain percentages of the described reducing agent, silver salt oxidizing agent, dye-forming coupler, and other addenda in a protective or other layer over the photographic layer or in a layer between the support and the photographic layer of a photographic element as described. The components must be in a location which enables their described interaction upon processing.

It is necessary that the photosensitive silver halide, as described, and other components in the photographic material be in reactive association with each other in order to provide the desired dye enhanced silver image. The term "in reactive association" as employed herein, is intended to mean that the photosensitive silver halide, the image-forming combination, the dye-forming coupler and the antifoggant according to the invention are in a location with respect to each other which enables the desired processing and provides a useful dye-enhanced silver image with reduced fog. It is believed that the latent image formed upon imagewise exposure of the photosensitive silver halide acts as a catalyst for the image-forming combination containing the described silver salt oxidizing agent and that the oxidized reducing agent resulting from the image-forming reaction reacts with the dye-forming coupler. While the exact nature of the reaction mechanisms involved and the image formation in the photographic material is not fully understood, it is believed that the reaction is an amplification reaction enabled by the catalytic effect of the latene image silver. In addition, the dye formation that results provides amplification to the resulting silver image.

If desired, other heat developable photographic materials can be useful in combination with the photographic materials according to the invention. The other heat developable photographic materials must be compatible with and not adversely affect the silver image formation and dye formation in a photographic material according to the invention. For example, a photographic element can comprise, respectively, a support having thereon (1) a heat developable photographic layer comprising photosensitive silver halide in reactive association with an image-forming combination comprising (i) a 3-amino-1H-1,2,4-triazole silver salt oxidizing agent, as described, with (ii) an organic reducing agent, especially a phenylenediamine or aminophenol silver halide developing agent, and a compound that is a dye-forming coupler as described with a binder and an antifoggant concentration of a 5-mercapto-1,2,4-triazole, also as described, and (2) a separate layer of the element containing a different heat developable photographic material containing photosensitive silver halide as a component with other necessary imaging materials. The optimum concentrations and ratios of components of these layers will depend upon such factors as the desired image, particular components of the photosensitive material, processing conditions and the like.

Another embodiment of the invention is a heat developable photographic composition comprising, in binder, described components (a), (b), (c) and (d) according to the invention.

Such a composition can be provided on a suitable support to provide a photographic element that is heat developable. The photographic element can comprise a variety of supports which can tolerate the processing conditions and temperatures useful according to the invention. Typical supports include cellulose ester film, poly(vinyl acetal) film, poly(ethylene terephthalate) film, polycarbonate film and polyester film supports that can withstand the described processing temperatures. Related film and resinous support materials as well as glass, paper, metal and the like supports which can withstand the processing temperatures described are also useful. Typically, a flexible support is most useful.

A paper support for the described photothermographic element can be corona discharge treated prior to coating the photographic composition onto the support. The corona discharge treatment can produce advantages, such as improved bonding between the paper support and the photographic composition layer. The paper support can be coated with a variety of compositions, such as starch with styrene-maleic anhydride materials, that can provide improved properties to the paper support prior to the decribed corona discharge treatment.

The described materials according to the invention can be coated on a suitable support by various coating procedures known in the photographic art including dip coating, airknife coating, curtain coating or extrusion coating. If desired, two or more layers can be coated simultaneously as known in the photographic art.

A variety of imagewise exposure means can be useful with the materials according to the invention. The photographic materials are typically sensitive to the ultraviolet and blue regions of the spectrum and exposure means which provide this radiation are preferred. Typically, however, if a spectral sensitizing dye or dye combination is employed in the photographic materials, exposure means using other ranges of the spectrum are applicable. Typically, a photographic element according to the invention is exposed imagewise with a visible light source, such as a tungsten lamp, although other sources of radiation are useful. Other sources of radiation which are useful include, for example, lasers, electron beams, X-ray sources and the like. The photographic materials according to the invention are typically exposed imagewise to provide a developable latent image.

A visible dye enhanced silver image can be developed in a material according to the invention within a short time. The image can be developed merely by uniformly heating the exposed photographic material to moderately elevated temperature. For example, the exposed heat developable photographic material can be heated uniformly to a temperature within the range of about 120° C to about 185° C, typically a temperature within the range of about 150° C to about 170° C. Heating is carried out until a desired image is developed, typically within about 1 to about 60 seconds, such as within about 1 to about 30 seconds. At the lower processing temperatures, such as at about 125° C, development of an image requires a longer processing time. However, at the lower processing temperature such as below about 140° C, a sufficient degree of post-processing stabilization may not be observed with the desired photographic material that contains the preferred silver salt oxidizing agent as described.

Another embodiment of the invention is a process of developing a dye enhanced silver image in an exposed heat developable photographic element as described comprising heating the photographic material to a temperature within the range of about 120° C to about 185° C until the desired image is developed.

Although it is often undesirable, due to the lack of control in preparation, all or a portion of the described photosensitive silver halide can be prepared in situ in the described heat developable photographic material according to the invention. Such a method of preparation of photosensitive silver halide in situ in a photographic material is described, for example, in U.S. Pat. No. 3,457,075 of Morgan et al., issued July 22, 1969.

Processing according to the invention is typically carried out under ambient conditions of pressure and humidity. Pressures and humidity outside normal atmospheric conditions can be employed if desired; however, normal atmospheric conditions are preferred.

A variety of means can be useful to provide the necessary heating of the described heat developable photographic material after exposure to provide a developed dye enhanced silver image. The heating means can be a simple hot plate, iron, roller, microwave heating means, infrared heating means or the like.

The following examples are included for a further understanding of the invention.

EXAMPLE 1

This is a comparative example.

The silver salt of 3-amino-5-benzylthio-1H-1,2,4-triazole was prepared as follows: 3-amino-5-benzylthio-1H-1,2,4-triazole (referred to herein as ABT) (185.4 grams) was dissolved in 1800 ml of ethanol and then added to a solution of 600 grams of gelatin in 3600 ml of distilled water. A solution of 102 grams of silver nitrate in 600 ml of distilled water was added to the resulting composition with stirring. The final mixture was blended for a total of 30 minutes. The resulting composition was designated as Dispersion A.

The described Dispersion A was combined with the following components and coated at the indicated coverages on a poly(ethylene terephthalate) film support:

| | |
|---|---|
| Dispersion A (as described) | 0.92 g Ag/m$^2$ |
| silver bromoiodide gelatino emulsion (2.5 mole % iodide) | 0.22 g Ag/m$^2$ |
| 4-amino-2-methoxy-N,N,5-trimethylaniline sulfate (reducing agent) | 0.81 g/m$^2$ |
| 2',6'-dihydroxytrifluoroacetanilide (dye-forming coupler) | 1.94 g/m$^2$ |
| surfactant (Surfactant 10G, a polyglycidol ether available from the Olin Corporation, U.S.A.) | 0.2 gm$^2$ |

The resulting coating was permitted to dry on the film support to provide a developable photographic element. The element was then imagewise exposed for $10^{-3}$ seconds in a commercial sensitometer through a graduated density step wedge. The resulting latent image was developed by contacting the exposed element for 15 seconds with a heated metal block at 155° C and 15 seconds at 165° C. The resulting density was observed and listed in the following Table I.

Table I

| Time/Temp. | D-max | D-midscale | D-min |
|---|---|---|---|
| 15 sec/155 C | 1.20 | 0.52 | 0.24 |
| 15 sec/165 C | 1.62 | 0.74 | 0.35 |

EXAMPLE 2

The procedure described in Example 1 was repeated with the exception that the final composition before coating contained sufficient 3-methyl-5-mercapto-1,2,4-triazole (antifoggant) to provide 11 mg per square meter of this compound in the heat developable photographic element before imagewise exposure. The photographic element was imagewise exposed and then heated as described in Example 1. The processed element had higher densities in the midscale and lower minimum density as indicated in the data in following Table II.

Table II

| Time/Temp. | D-max | D-midscale | D-min |
|---|---|---|---|
| 15 sec/155 C | 1.00 | 0.64 | 0.12 |
| 15 sec/165 C | 1.32 | 1.07 | 0.14 |

EXAMPLE 3

This is a comparative example.

The procedure described in Example 1 was repeated with the exception that sufficient 3-mercapto-1,2,4-triazole was added to provide 5.5 mg per square meter of this compound in the heat developable photographic element. The element was imagewise exposed and processed as described in Example 1. The resulting image had a maximum and minimum density as indicated in following Table III.

Table III

| Time/Temp. | D-max | D-midscale | D-min |
|---|---|---|---|
| 15 sec/155 C | 0.44 | 0.24 | 0.20 |
| 15 sec/165 C | 1.22 | 0.37 | 0.22 |

EXAMPLE 4

This is a comparative example.

The procedure described in Example 3 was repeated except that the final element before exposure contained 33 mg per square meter of 3-mercapto-1,2,4-triazole. The element was imagewise exposed and processed as described in Example 1 providing the density values indicated in following Table IV.

Table IV

| Time/Temp. | D-max | D-min |
|---|---|---|
| 15 sec/155 C | 0.28 | 0.24 |
| 15 sec/165 C | 0.62 | 0.24 |

The results from Examples 3 and 4 indicate some antifogging action is provided by the 1,2,4-triazole compound used in Examples 3 and 4 along with severe development restraint. The development restraint is not observed with the material and process of Example 2 and greater antifogging activity is obtained.

EXAMPLE 5

The procedure described in Example 1 is repeated with the exception that the photographic element before exposure contained 33 mg per square meter of 3-imino-4-phenyl-5-thiourazole. The resulting photographic element was imagewise exposed and processed as described in Example 1. The heat processed element showed accelerated development throughout the exposure scale along with high fog. The image developed had the following density values:

Table V

| Time/Temp. | D-max | D-midscale | D-min |
|---|---|---|---|
| 15 sec/155 C | 1.70 | 1.44 | 0.36 |
| 15 sec/165 C | 2.35 | 2.10 | 1.29 |

EXAMPLE 6

The procedure described in Example 5 was repeated except that the photographic element before imagewise exposure contained 44 mg per square foot of 3-imino-4-phenyl-5-thiourazole and 44 mg per square foot of 3-methyl-5-mercapto-1,2,4-triazole. The photographic element was imagewise exposed and processed as described in Example 1. The developed image indicated that the acceleration observed in the element of Example 5 was also observed in the element of Example 6. In addition, the image developed according to Example 6 demonstrated satisfactory antifogging action of 3-methyl-5-mercapto-1,2,4-triazole as demonstrated in Example 2. The image developed according to Example 6 had the density values as given in following Table VI.

Table VI

| Time/Temp. | D-max | D-midscale | D-min |
|---|---|---|---|
| 15 sec/155 C | 1.68 | 1.56 | 0.17 |
| 15 sec/165 C | 1.78 | 1.68 | 0.18 |

EXAMPLE 7

The procedure described in Example 1 was repeated with the exception that the photographic element before imagewise exposure contained 11 mg per square meter of 1-phenyl-2-tetrazoline-5-thione. The photographic element was imagewise exposed and processed as described in Example 1. The resulting image illustrated that the compound 1-phenyl-2-tetrazoline-5-thione provided accelerated development with undesired fog. The developed image had the density values given in following Table VII:

Table VII

| Time/Temp. | D-max | D-midscale | D-min |
|---|---|---|---|
| 15 sec/155 C | 1.48 | 0.94 | 0.18 |

Table VII-continued

| Time/Temp. | D-max | D-midscale | D-min |
|---|---|---|---|
| 15 sec/165 C | 2.02 | 1.85 | 0.46 |

EXAMPLE 8

The procedure described in Example 7 was repeated with the exception that the photographic element before imagewise exposure contained 33 mg per square meter of 1-phenyl-2-tetrazoline-5-thione plus 33 mg per square meter of 3-methyl-5-mercapto-1,2,4-triazole. The photographic element was imagewise exposed and processed as described in Example 1. After imagewise exposure processing of the element as described in Example 1, the resulting developed image had the following maximum and minimum density values as given in following Table VIII:

Table VIII

| Time/Temp. | D-max | D-midscale | D-min |
|---|---|---|---|
| 15 sec/155 C | 1.8 | 1.56 | 0.16 |
| 15 sec/165 C | 1.9 | 1.8 | 0.18 |

EXAMPLE 9

This is a comparative example.

The procedure described in Example 1 was repeated with the exception that the photographic element contained 33 mg per square meter of 4-methyl-3,5-dimercapto-1,2,4-triazole. The photographic element was imagewise exposed and processed as described in Example 1. The developed image had maximum and minimum density values as given in following Table IX.

Table IX

| Time/Temp. | D-max | D-midscale | D-min |
|---|---|---|---|
| 15 sec/155 C | 1.90 | 1.64 | 0.20 |
| 15 sec/165 C | 1.88 | 1.74 | 0.30 |

EXAMPLE 10

The procedure described in Example 1 was repeated with the exception that the photographic element contained 55 mg per square meter of 3-ethyl-5-mercapto-1,2,4-triazole. The photographic element was imagewise exposed and processed as described in Example 1. The resulting developed image had high maximum density in the midscale of the sensitometric curve indicating some development acceleration at the lower processing temperatures when compared to the image developed according to Example 1. The fog level was similar to that observed in the element of Example 1. The density values for the developed image are given in following Table X.

Table X

| Time/Temp. | D-max | D-midscale | D-min |
|---|---|---|---|
| 15 sec/155 C | 1.68 | 1.52 | 0.22 |
| 15 sec/165 C | 1.65 | 1.55 | 0.34 |

EXAMPLE 11

This is a comparative example.

The procedure described in Example 1 was repeated with the exception that the photographic element contained 33 mg per square meter of 4-methyl-5-mercapto-1,2,4-triazole. The element was imagewise exposed and processed as described in Example 1 and showed accelerated development with high fog. The density values of the resulting image are given in following Table XI.

Table XI

| Time/Temp. | D-max | D-midscale | D-min |
|---|---|---|---|
| 15 sec/155 C | 1.86 | 1.68 | 0.52 |
| 15 sec/165 C | 1.88 | 1.78 | 1.04 |

EXAMPLE 12

The procedure described in Example 11 was repeated with the exception that the photographic element before imagewise exposure contained 16.5 mg per square meter of 4-methyl-5-mercapto-1,2,4-triazole plus 33 mg per square meter of 3-methyl-5-mercapto-1,2,4-triazole. The photographic element was imagewise exposed and processed as described in Example 1. The resulting developed image indicated that the photographic element provided development acceleration and good antifogging activity. The density values of the developed image are given in following Table XII.

Table XII

| Time/Temp. | D-max | D-midscale | D-min |
|---|---|---|---|
| 15 sec/155 C | 1.65 | 1.53 | 0.16 |
| 15 sec/165 C | 1.65 | 1.42 | 0.20 |

It was noted that the addition of the compound 3-methyl-5-mercapto-1,2,4-triazole to compounds which themselves provided only development acceleration, resulted in a surprising and unexpected combination in a photographic element according to the invention which provided both development acceleration and antifogging activity. This can be seen from the comparison of the results of Example 6 with Example 5, Example 8 with Example 7, and Example 12 with Example 11.

The invention has been described in detail with particular reference to preferred embodiments thereof, but it will be understood that variations and modifications can be effected within the spirit and scope of the invention.

What is claimed is:

1. In a heat developable photographic element for providing a dye enhanced silver image comprising a support having thereon, in binder, in reactive association, (a) photosensitive silver halide, (b) a dye-forming coupler, and (c) an oxidation-reduction image-forming combination comprising (i) a 3-amino-1H-1,2,4-triazole silver salt oxidizing agent consisting essentially of a silver salt of a 3-amino-1H-1,2,4-triazole represented by the structure

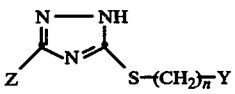

wherein Y is aryl containing 6 to 12 carbon atoms; $n$ is 0 to 2; and Z is hydrogen, hydroxyl or amine, with (ii) an organic reducing agent which in its oxidized form forms a dye with a dye-forming coupler, the improvement wherein said element comprises (d) an antifoggant concentration of a 5-mercapto-1,2,4-triazole represented by the formula:

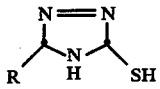

wherein R is H or alkyl containing 1 to 3 carbon atoms.

2. A heat developable photographic element as in claim 1 wherein said antifoggant concentration is within the range of about 5.5 mg to about 110 mg of said 5-mercapto-1,2,4-triazole per square meter of said support.

3. A heat developable photographic element as in claim 1 wherein said 5-mercapto-1,2,4-triazole consists essentially of 3-methyl-5-mercapto-1,2,4-triazole.

4. A heat developable photographic element as in claim 1 wherein (a) consists essentially of a photosensitive gelatino silver bromoiodide emulsion.

5. A heat developable photographic element as in claim 1 wherein said improvement also comprises in said element a development accelerating concentration of a 5-thiourazole development accelerator.

6. A heat developable photographic element as in claim 1 wherein said improvement also comprises in said element a development accelerating concentration of a 5-thiourazole development accelerator within the range of about 5.0 mg to about 220 mg of said development accelerator per square meter of said support.

7. A heat developable photographic element as in claim 1 wherein said improvement also comprises in said element a development accelerating concentration of a 5-thiourazole development accelerator consisting essentially of 3-imino-4-phenyl-5-thiourazole.

8. A heat developable photographic element as in claim 1 wherein said improvement also comprises in said element a development accelerating concentration of 3-imino-4-phenyl-5-thiourazole within the range of about 5.0 mg to about 220 mg of said thiourazole per square meter of said support.

9. A heat developable photographic element as in claim 1 wherein said improvement also comprises in said element a development accelerating concentration of a 2-tetrazoline-5-thione development accelerator.

10. A heat developable photographic element as in claim 1 wherein said improvement also comprises in said element a development accelerating concentration of 1-phenyl-2-tetrazoline-5-thione.

11. A heat developable photographic element as in claim 1 wherein said improvement also comprises in said element a development accelerating concentration of 1-phenyl-2-tetrazoline-5-thione within the range of about 5.5 mg to about 220 mg of said 5-thione per square meter of said support.

12. A heat developable photographic element as in claim 1 wherein said improvement also comprises in said element a development accelerating concentration of a 5-mercapto-1,2,4-triazole development accelerator consisting essentially of 4-methyl-5-mercapto-1,2,4-triazole.

13. A heat developable photographic element as in claim 1 wherein said improvement also comprises in said element a development accelerating concentration of 4-methyl-5-mercapto-1,2,4-triazole within the range of about 5.5 mg to about 220 mg of said 1,2,4-triazole per square meter of said support.

14. A heat developable photographic element as in claim 1 wherein said silver halide is spectrally sensitized with a spectral sensitizing dye.

15. In a heat developable photographic element for providing a dye enhanced silver image comprising a support having thereon, in a gelatino binder, in reactive association, (a) photosensitive silver halide gelatino emulsion,
(b) an oxidation-reduction image-forming combination comprising
  (i) a 3-amino-5-benzylthio-1H-1,2,4-triazole silver salt, with
  (ii) a phenylenediamine reducing agent consisting essentially of 4-amino-2-methoxy-N,N,5-trimethylaniline sulfate,
(c) a resorcinol dye-forming coupler consisting essentially of 2',6'-dihydroxytrifluoroacetanilide, the improvement wherein said element comprises (d) an antifoggant concentration of 3-methyl-5-mercapto-1,2,4-triazole.

16. A heat developable photographic element as in claim 15 wherein said silver halide emulsion is spectrally sensitized with a spectral sensitizing dye.

17. A heat developable photographic element as in claim 15 wherein said improvement also comprises in said element a development accelerating concentration of 1-phenyl-2-tetrazoline-5-thione.

18. A heat developable photographic element as in claim 15 wherein said improvement also comprises in said element a development accelerating concentration of 3-imino-4-phenyl-5-thiourazole.

19. A heat developable photographic element as in claim 15 wherein said improvement also comprises in said element a development accelerating concentration of 4-methyl-5-mercapto-1,2,4-triazole.

20. In a heat developable photographic composition comprising, in binder, (a) photosensitive silver halide,
(b) a dye-forming coupler, and
(c) an oxidation-reduction image-forming combination comprising
  (i) a 3-amino-1H-1,2,4-triazole silver salt oxidizing agent consisting essentially of a silver salt of a 3-amino-1H-1,2,4-triazole represented by the structure

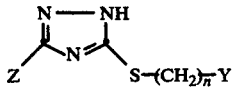

wherein Y is aryl containing 6 to 12 carbon atoms; $n$ is 0 to 2; and Z is hydrogen, hydroxyl or amine, with (ii) an organic reducing agent which in its oxidized form forms a dye with a dye-forming coupler, the improvement wherein said composition comprises (d) an antifoggant concentration of a 5-mercapto-1,2,4-triazole represented by the formula:

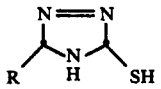

wherein R is H or alkyl containing 1 to 3 carbon atoms.

21. A heat developable photographic composition as in claim 20 wherein said antifoggant concentration is within the range of 0.45 g to 9 g of said 5-mercapto-1,2,4-triazole per mole of silver in said composition.

22. A heat developable photographic composition as in claim 20 wherein said mercapto-1,2,4-triazole consists essentially of 3-methyl-5-mercapto-1,2,4-triazole.

23. A heat developable photographic composition as in claim 20 wherein (a) consists essentially of a photosensitive gelatino silver bromoiodide emulsion.

24. A heat developable photographic composition as in claim 20 wherein said silver halide is spectrally sensitized with a spectral sensitizing dye.

25. A heat developable photographic composition as in claim 20 also comprising a development accelerating concentration of a 5-thiourazole development accelerator.

26. A heat developable photographic composition as in claim 20 wherein said improvement also comprises in said composition a development accelerating concentration of a 5-thiourazole development accelerator consisting essentially of 3-imino-4-phenyl-5-thiourazole.

27. A heat developable photographic composition as in claim 20 wherein said improvement also comprises in said composition a development accelerating concentration of a 2-tetrazoline-5-thione development accelerator.

28. A heat developable photographic composition as in claim 20 wherein said improvement also comprises in said composition a development accelerating concentration of 1-phenyl-2-tetrazoline-5-thione.

29. A heat developable photographic composition as in claim 20 wherein said improvement also comprises in said composition a development accelerating concentration of a 5-mercapto-1,2,4-triazole development accelerator consisting essentially of 4-methyl-5-mercapto-1,2,4-triazole.

30. In a heat developable photographic composition for providing a dye enhanced silver image comprising, in a gelatino binder, (a) photosensitive silver halide gelatino emulsion,
(b) an oxidation-reduction image-forming combination comprising
  (i) a 3-amino-5-benzylthio-1H-1,2,4-triazole silver salt, with
  (ii) a phenylenediamine reducing agent consisting essentially of 4-amino-2-methoxy-N,N,5-trimethylaniline sulfate, and
(c) a resorcinol dye-forming coupler consisting essentially of 2',6'-dihydroxytrifluoroacetanilide, the improvement wherein said composition comprises (d) an antifoggant concentration of 3-methyl-5-mercapto-1,2,4-triazole.

31. A heat developable photographic composition as in claim 30 wherein said improvement also comprises in said composition a development accelerating concentration of 1-phenyl-2-tetrazoline-5-thione.

32. A heat developable photographic composition as in claim 30 wherein said improvement also comprises in said composition a development accelerating concentration of 3-imino-4-phenyl-5-thiourazole.

33. A heat developable photographic composition as in claim 30 wherein said improvement also comprises in said composition a development accelerating concentration of 4-methyl-5-mercapto-1,2,4-triazole.

34. A process of developing a dye enhanced silver image in an exposed heat developable photographic element comprising a support having thereon, in binder, in reactive association, (a) photosensitive silver halide, (b) a dye-forming coupler, (c) an oxidation-reduction image-forming combination comprising (i) a 3-amino-1H-1,2,4-triazole silver salt oxidizing agent consisting essentially of a silver salt of a 3-amino-1H-1,2,4-triazole represented by the structure

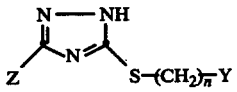

wherein Y is aryl containing 6 to 12 carbon atoms; *n* is 0 to 2; and Z is hydrogen, hydroxyl or amine, with (ii) an organic reducing agent which in its oxidized form forms a dye with a dye-forming coupler, and (d) an antifoggant concentration of a 5-mercapto-1,2,4-triazole represented by the formula:

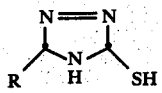

wherein R is H or alkyl containing 1 to 3 carbon atoms, comprising heating said element to a temperature within the range of about 120° C to about 185° C until said image is developed.

35. A process of developing a dye enhanced silver image in an exposed heat developable photographic element comprising a support having thereon, in a gelatino binder, in reactive association, (a) photosensitive silver halide gelatino emulsion, (b) an oxidation-reduction image-forming combination comprising (i) a 3-amino-5-benzylthio-1H-1,2,4-triazole silver salt, with (ii) a phenylenediamine reducing agent consisting essentially of 4-amino-2-methoxy-N,N,5-trimethylaniline sulfate, (c) a resorcinol dye-forming coupler consisting essentially of 2',6'-dihydroxytrifluoroacetanilide, and (d) an antifoggant concentration of 3-methyl-5-mercapto-1,2,4-triazole, comprising heating said element to a temperature within the range of about 120° C to about 185° C until said image is developed.

* * * * *

UNITED STATES PATENT AND TRADEMARK OFFICE

CERTIFICATE OF CORRECTION

PATENT NO. : 4,137,079

DATED : January 30, 1979

INVENTOR(S) : Conrad G. Houle

It is certified that error appears in the above-identified patent and that said Letters Patent are hereby corrected as shown below:

Page 1, before the paragraph entitled "Abstract", "Rochard E. Knapp" should read ---Richard E. Knapp---.

Column 1, line 14, "gent" should read ---agent---; line 59, "Eastmen" should read ---Eastman---.

Column 2, line 7, "boarder" should read ---broader---.

Column 3, line 26, "iage" should read ---image---.

Column 4, line 3, before "determined" delete "according" and insert ---be---; line 8, "accoridng" should read ---according---; line 34, "materal" should read ---material---; line 47, "squre" should read ---square---.

Column 6, line 19, "0.5" should read ---0.05---; line 58, "cntain" should read ---contain---.

Column 7, lines 19-20, that part of the formula reading "sulfoniline" should read ---sulfoaniline---; line 60, "parricular" should read ---particular---.

UNITED STATES PATENT AND TRADEMARK OFFICE

CERTIFICATE OF CORRECTION

PATENT NO. : 4,137,079

DATED : January 30, 1979

INVENTOR(S) : Conrad G. Houle

It is certified that error appears in the above-identified patent and that said Letters Patent are hereby corrected as shown below:

Column 8, line 45, "Lanholm" should read ---Landholm---.

Column 9, line 15, "decy" should read ---decyl---.

Column 10, line 10, before "cellulose" insert ---derivatives,---; line 54, "haide" should read ---halide---.

Column 11, line 2, "obtain" should read ---contain---.

Column 12, line 49, "photograhic" should read ---photographic---.

Column 13, line 61, "latene" should read ---latent---.

Column 15, line 21, "desired" should read ---described---.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*